US007357844B2

(12) United States Patent
Inoue

(10) Patent No.: US 7,357,844 B2
(45) Date of Patent: Apr. 15, 2008

(54) SOFT MAGNETIC METALLIC GLASS ALLOY

(75) Inventor: Akihisa Inoue, Miyagi (JP)

(73) Assignee: Japan Science and Technology Agency, Kawaguchi-shi (JP)

( * ) Notice: Subject to any disclaimer, the term of this patent is extended or adjusted under 35 U.S.C. 154(b) by 11 days.

(21) Appl. No.: 10/506,168

(22) PCT Filed: Feb. 27, 2003

(86) PCT No.: PCT/JP03/02257

§ 371 (c)(1),
(2), (4) Date: Mar. 25, 2005

(87) PCT Pub. No.: WO03/074749

PCT Pub. Date: Sep. 12, 2003

(65) Prior Publication Data

US 2005/0161122 A1 Jul. 28, 2005

(30) Foreign Application Priority Data

Mar. 1, 2002 (JP) ..... 2002-055291

(51) Int. Cl.
*H01F 1/153* (2006.01)

(52) U.S. Cl. ..... 148/304; 148/403

(58) Field of Classification Search ..... None
See application file for complete search history.

(56) References Cited

U.S. PATENT DOCUMENTS 4,450,206 A * 5/1984 Ames et al. ..... 428/606

(Continued)

FOREIGN PATENT DOCUMENTS

DE 198 60 250 C1 12/1998

(Continued)

OTHER PUBLICATIONS

Mende, "New Truck Transmission Shifts Smoothly", Machine Design, 62, Feb. 22, 1990, No. 4, Cleveland, Ohio, US, pp. 60-61.

(Continued)

*Primary Examiner*—John P. Sheehan
(74) *Attorney, Agent, or Firm*—Westerman, Hattori, Daniels & Adrian, LLP.

(57) ABSTRACT

Disclosed is a soft magnetic Fe—B—Si-based metallic glass alloy with high glass forming ability which has a supercooled-liquid temperature interval ($\Delta T_\chi$) of 40 K or more, a reduced glass-transition temperature ($T_g/T_m$) of 0.56 or more and a saturation magnetization of 1.4 T or more. The metallic glass alloy is represented by the following composition formula: $(Fe_{1-a-b}B_aSi_b)_{100-\chi}M_\chi$, wherein a and b represent an atomic ratio, and satisfy the following relations: $0.1 \leqq a \leqq 0.17$, $0.06 \leqq b \leqq 0.15$ and $0.18 \leqq a+b \leqq 0.3$, M is one or more elements selected from the group consisting of Zr, Nb, Ta, Hf, Mo, Ti, V, Cr, Pd and W, and $\chi$ satisfies the following relation: 1 atomic % $\leqq \chi \leqq$ 10 atomic %. The present invention overcomes restrictions in preparing a metallic glass bar with a thickness of 1 mm or more from conventional Fe—B—Si-based metallic glasses due to their poor glass forming ability, and provides a high saturation-magnetization Fe—B—Si-based metallic glass allowing the formation of bulk metallic glass, which serves as a key technology for achieving a broader application fields of metallic glass products.

2 Claims, 6 Drawing Sheets

U.S. PATENT DOCUMENTS

| | | | | | |
|---|---|---|---|---|---|
| 4,462,826 | A | * | 7/1984 | Inomata et al. | 148/304 |
| 4,473,401 | A | * | 9/1984 | Masumoto et al. | 148/403 |
| 4,584,034 | A | * | 4/1986 | Hagiwara et al. | 148/304 |
| 4,682,516 | A | | 7/1987 | Okubo | |
| 4,721,002 | A | | 1/1988 | Horii | |
| 4,834,814 | A | * | 5/1989 | Hasegawa et al. | 148/304 |
| 4,834,816 | A | | 5/1989 | Hasegawa et al. | |
| 4,858,495 | A | | 8/1989 | Horsch | |
| 4,865,664 | A | * | 9/1989 | Sato et al. | 148/403 |
| 4,923,533 | A | * | 5/1990 | Shigeta et al. | 148/304 |
| 5,055,144 | A | * | 10/1991 | Fish et al. | 148/509 |
| 5,284,528 | A | * | 2/1994 | Hasegawa et al. | 148/304 |
| 5,445,041 | A | | 8/1995 | Zaiser et al. | |
| 5,919,577 | A | * | 7/1999 | Hasegawa et al. | 428/606 |
| 5,976,274 | A | * | 11/1999 | Inoue et al. | 148/304 |

FOREIGN PATENT DOCUMENTS

| | | | | | |
|---|---|---|---|---|---|
| EP | 58154257 | | | 3/1983 | |
| EP | 1 026 423 | A2 | | 8/2000 | |
| EP | 1 026 423 | A3 | | 8/2000 | |
| GB | 1 375 467 | | | 11/1974 | |
| JP | 54-56919 | | * | 5/1979 | 148/304 |
| JP | 57-169068 | | * | 10/1982 | 148/304 |
| JP | 58-213857 | | * | 12/1983 | 148/403 |
| JP | 59-31848 | | * | 2/1984 | 148/304 |
| JP | 59-59862 | | * | 4/1984 | 148/304 |
| JP | 59-208057 | | * | 11/1984 | 148/304 |
| JP | 60-103160 | | * | 6/1985 | 148/304 |
| JP | 60-106949 | | * | 6/1985 | 148/403 |
| JP | 60-145360 | | * | 7/1985 | 148/304 |
| JP | 61-30008 | | * | 2/1986 | 148/304 |
| JP | 61-157661 | | * | 7/1986 | 148/403 |
| JP | 61-183454 | | * | 8/1986 | 148/304 |
| JP | 62-179704 | | * | 8/1987 | 148/304 |
| JP | 2-3213 | | * | 1/1990 | 148/304 |

OTHER PUBLICATIONS

Patent Abstracts of Japan, Publication No. 2001-279387, dated Oct. 10, 2001. Cited in the PCT search report.

Patent Abstracts of Japan, Publication No. 61-295602, dated Dec. 26, 1986. Cited in the PCT search report.

Patent Abstracts of Japan, Publication No. 2001-316782, dated Nov. 16, 2001. Cited in the specification.

Patent Abstracts of Japan, Publication No. 11-071647, dated Mar. 16, 1999. Cited in the specification.

Patent Abstracts of Japan, Publication No. 11-131199, dated May 18, 1999. Cited in the specification.

* cited by examiner

SOFT MAGNETIC METALLIC GLASS ALLOY

TECHNICAL FIELD

The present invention relates to a soft magnetic Fe—B—Si-based metallic glass alloy with high saturation magnetization and high glass forming ability.

BACKGROUND ART

Conventional metallic glasses include Fe—P—C-based metallic glass which was first produced in the 1960s, (Fe, Co, Ni)—P—B-based alloy, (Fe, Co, Ni)—Si—B-based alloy, (Fe, Co, Ni)—(Zr, Hf. Nb)-based alloy and (Fe, Co, Ni)—(Zr, Hf, Nb)—B-based alloy which were produced in the 1970s.

All of the above alloys are essentially subjected to a rapid solidification process at a cooling rate of $10^4$ K/s or more, and an obtained sample is a thin strip having a thickness of 200 μm or less. Between 1988 and 2001, various metallic glass alloys exhibiting high glass forming ability, which have a composition, such as Ln—Al-TM, Mg—Ln-TM, Zr—Al-TM, Pd—Cu—Ni—P, (Fe, Co, Ni)—(Zr, Hf. Nb)—B, Fe—(Al, Ga)—P—B—C, Fe—(Nb, Cr, Mo)—(Al, Ga)—P—B—C, Fe—(Cr, Mo)—Ga—P—B—C, Fe—Co—Ga—P—B—C, Fe—Ga—P—B—C or Fe—Ga—P—B—C—Si (wherein Ln is a rare-earth element, and TM is a transition metal), were discovered. These alloys can be formed as a metallic glass bar having a thickness of 1 mm or more.

The inventor previously filed patent applications concerning a soft magnetic metallic glass alloy of Fe—P—Si—(C, B, Ge)-(group-IIIB metal element, group-IVB metal element) (Patent Publication 1); a soft magnetic metallic glass alloy of (Fe, Co, Ni)—(Zr, Nb, Ta, Hf, Mo, Ti, V)—B (Patent Publication 2); and a soft magnetic metallic glass alloy of Fe—(Cr, Mo)—Ga—P—C—B (Patent Publication 3).

Parent Publication 1: Japanese Patent Laid-Open Publication No. 11-71647

Parent Publication 2: Japanese Patent Laid-Open Publication No. 11-131199

Parent Publication 3: Japanese Patent Laid-Open Publication No. 2001-316782

DISCLOSURE OF INVENTION

The inventor previously found out several soft magnetic bulk metallic glass alloys with a saturation magnetization of up to 1.4 T. However, in view of practical applications, it is desired to provide a soft magnetic metallic glass alloy having a saturation magnetization of 1.4 T or more.

Through researches on various alloy compositions in order to achieve the above object, the inventor found a soft magnetic Fe—B—Si-based metallic glass alloy composition exhibiting clear glass transition and wide supercooled liquid region and having higher glass formation ability and higher saturation magnetization, and has accomplished the present invention.

Specifically, the present invention provides a soft magnetic Fe—B—Si-based metallic glass alloy with high glass forming ability which has a supercooled-liquid temperature interval ($\Delta T_\chi$) of 40 K or more, a reduced glass-transition temperature ($T_g/T_m$) of 0.56 or more and a saturation magnetization of 1.4 T or more. The metallic glass alloy is represented by the following composition formula: $(Fe_{1-a-b}B_aSi_b)_{100-\chi}M_\chi$, wherein a and b represent an atomic ratio, and satisfy the following relations: $0.1 \leqq a \leqq 0.17$, $0.06 \leqq b \leqq 0.15$ and $0.18 \leqq a+b \leqq 0.3$, M is one or more elements selected from the group consisting of Zr, Nb, Ta, Hf, Mo, Ti, V, Cr, Pd and W, and $\chi$ satisfies the following relation: 1 atomic % $\leqq \chi \leqq$ 10 atomic %.

In a metallic glass prepared using the alloy with the above composition through a single-roll rapid liquid cooling process in the form of thin strip (or film, ribbon) having a thickness of 0.2 mm or more, a supercooled-liquid temperature interval (or the temperature interval of a supercooled liquid region) ($\Delta T_\chi$), which is expressed by the following formula: $\Delta T_\chi = T_\chi - T_g$ (wherein $T_\chi$ is a crystallization temperature, and $T_g$ is a glass transition (vitrification) temperature), is 40 K or more, and a reduced glass-transition temperature ($T_g/T_m$) is 0.56 or more.

During the course of preparing a metallic glass using the liquid alloy with the above composition through a cupper-mold casting process, heat generation caused by significant glass transition and crystallization is observed in a thermal analysis. A critical thickness or diameter in glass formation is 1.5 mm. This proves that metallic glass can be prepared through a cupper-mold casting process.

In the above alloy composition of the present invention, a primary component or Fe is an element playing a role in creating magnetism. Thus, Fe is essentially contained in an amount of 64 atomic % or more to obtain high saturation magnetization and excellent soft magnetic characteristics, and may be contained in an amount of up to 81 atomic %.

In the above alloy composition of the present invention, metalloid elements B and Si play a role in forming an amorphous phase. This role is critical to obtain a stable amorphous structure. In $Fe_{1-a-b}B_aSi_b$, the atomic ratio of a+b is set in the range of 0.18 to and 0.3, and the remainder is Fe. If the atomic ratio of a+b is outside this range, it is difficult to form an amorphous phase. It is required to contain both B and Si. If either one of B and Si is outside the above composition range, the glass forming ability is deteriorated to cause difficulties in forming a bulk metallic glass.

In the above alloy composition of the present invention, the addition of the element M is effective to provide enhanced glass forming ability. In the alloy composition of the present invention, the element M is added in the range of 1 atomic % to 10 atomic %. If the element M is outside this range and less than 1 atomic %, the supercooled-liquid temperature interval ($\Delta T_\chi$) will disappear. If the element M is greater than 10 atomic %, the saturation magnetization will be undesirably reduced.

The Fe—B—Si-based alloy of the present invention may further contain 3 atomic % or less of one or more elements selected from the group consisting of P, C, Ga and Ge. The addition of the one or more elements allows a coercive force to be reduced from 3.5 A/m to 3.0 A/m, or provides enhanced soft magnetic characteristics. On the other hand, if the content of the one or more elements becomes greater than 3 atomic %, the saturation magnetization will be lowered as the content of Fe is reduced. Thus, the content of the one or more elements is set at 3 atomic % or less.

In the above alloy composition of the present invention, any deviation from the above defined composition ranges causes deteriorated glass forming ability to create/grow crystals during the process of solidification of liquid metals so as to form a mixed structure of a glass phase and a crystal phase. If the deviation from the composition range becomes larger, an obtained structure will have only a crystal phase without any glass phase.

The Fe—B—Si alloy of the present invention has high glass forming ability allowing a metallic glass round bar with a diameter of 1.5 mm to be prepared through a copper-mold casting process. Further, at the same cooling rate, a thin wire with a minimum diameter of 0.4 mm can be prepared through an in-rotating-water spinning process, and a metallic glass powder with a minimum particle diameter of 0.5 mm through an atomization process.

BEST MODE FOR CARRYING OUT THE INVENTION

INVENTIVE EXAMPLES 1 TO 14, COMPARATIVE EXAMPLES 1 TO 7

Figure 6:
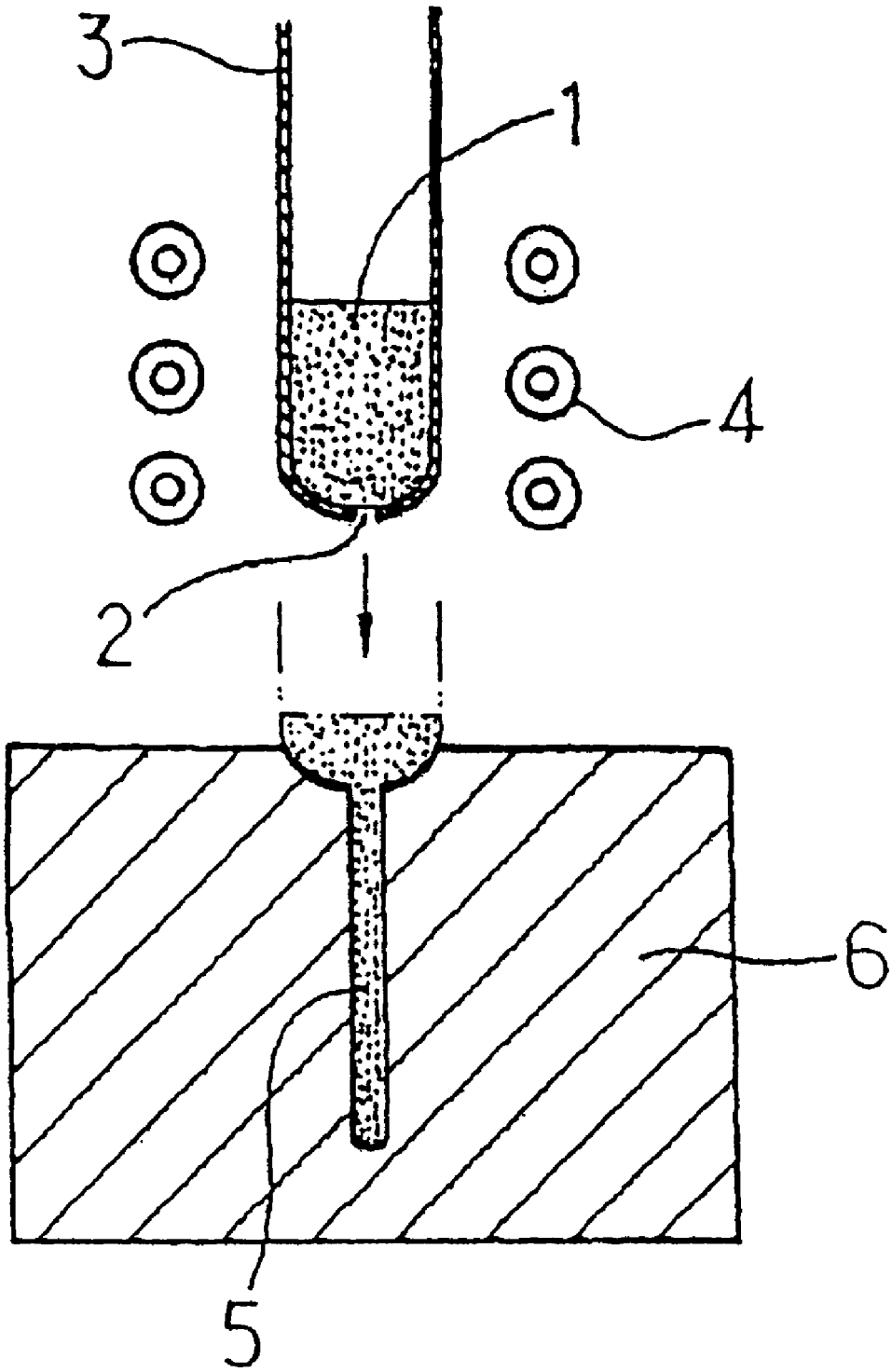
FIG. 6 is a schematic side view of an apparatus for use in preparing an alloy sample of a cast bar through a copper-mold casting process.

FIG. 6 is a schematic side view of an apparatus used in preparing an alloy sample with a diameter of 0.5 to 2 mm through a copper-mold casting process. A molten alloy 1 having a given composition was first prepared through an arc melting process. The alloy 1 was inserted into a silica tube 3 having a front end formed with a small opening 2, and molted using a high-frequency coil 4. Then, the silica tube 3 was disposed immediately above a copper mold 6 formed with a vertical hole 5 having a diameter of 0.5 to 2 mm to serve as a casting space, and a given pressure (1.0 Kg/cm$^2$) of argon gas was applied onto the molten metal 1 in the silica tube 3 to inject the molten metal 1 from the small opening 2 (diameter: 0.5) of the silica tune 3 into the hole 5 of the copper mold 6. The injected molten metal was left uncontrolled and solidified to obtain a cast bar having a diameter of 0.5 mm and a length of 50 mm.

Table 1 shows the respective alloy compositions of Inventive Examples 1 to 14 and Comparative Examples 1 to 7, and the respective Curie temperatures (Tc), glass transition temperatures ($T_g$) and crystallization temperatures ($T_\chi$) of Inventive Examples 1 to 14 measured using a differential scanning calorimeter. Further, the generated heat value due to crystallization in a sample was measured using a differential scanning calorimeter, and compared with that of a completely vitrified strip prepared through a single-roll rapid liquid cooling process to evaluate the volume fraction of a glass phase (Vf-amo.) contained in the sample.

Table 1 also shows the respective saturation magnetizations (Is) and coercive forces (Hc) of Inventive Examples 1 to 14 measured using a vibrating-sample magnetometer and an I—H loop tracer.

TABLE 1

| | Alloy Composition | Diameter (mm) | $T_g$ (K) | $T_\chi$ (k) | $T_\chi - T_g$ (K) | $T_g/T_m$ | $V_{f\text{-amo.}}$ | Is (T) | Hc (A/m) |
|---|---|---|---|---|---|---|---|---|---|
| Inventive Example 1 | $(Fe_{0.75}B_{0.15}Si_{0.10})_{99}Nb_1$ | 0.5 | 815 | 858 | 43 | 0.56 | 100 | 1.50 | 3.7 |
| Inventive Example 2 | $(Fe_{0.75}B_{0.15}Si_{0.10})_{98}Nb_2$ | 1.0 | 812 | 870 | 58 | 0.57 | 100 | 1.49 | 3.5 |
| Inventive Example 3 | $(Fe_{0.75}B_{0.15}Si_{0.10})_{96}Nb_4$ | 1.5 | 835 | 885 | 50 | 0.61 | 100 | 1.48 | 3.0 |
| Inventive Example 4 | $(Fe_{0.75}B_{0.15}Si_{0.10})_{94}Nb_6$ | 1.0 | 820 | 865 | 45 | 0.58 | 100 | 1.46 | 3.0 |
| Inventive Example 5 | $(Fe_{0.75}B_{0.15}Si_{0.10})_{92}Nb_8$ | 0.5 | 815 | 855 | 40 | 0.57 | 100 | 1.43 | 3.5 |
| Inventive Example 6 | $(Fe_{0.775}B_{0.125}Si_{0.10})_{98}Nb_2$ | 0.5 | 760 | 805 | 45 | 0.56 | 100 | 1.51 | 3.0 |
| Inventive Example 7 | $(Fe_{0.775}B_{0.125}Si_{0.10})_{96}Nb_4$ | 1.0 | 755 | 810 | 55 | 0.59 | 100 | 1.49 | 2.5 |
| Inventive Example 8 | $(Fe_{0.75}B_{0.15}Si_{0.10})_{99}Zr_1$ | 0.5 | 815 | 870 | 55 | 0.58 | 100 | 1.53 | 2.8 |
| Inventive Example 9 | $(Fe_{0.75}B_{0.15}Si_{0.10})_{98}Zr_2$ | 0.5 | 810 | 860 | 50 | 0.58 | 100 | 1.51 | 3.0 |
| Inventive Example 10 | $(Fe_{0.75}B_{0.15}Si_{0.10})_{96}Hf_4$ | 0.5 | 820 | 865 | 45 | 0.59 | 100 | 1.47 | 3.0 |
| Inventive Example 11 | $(Fe_{0.75}B_{0.15}Si_{0.10})_{94}Hf_6$ | 1.0 | 815 | 865 | 50 | 0.60 | 100 | 1.45 | 3.0 |
| Inventive Example 12 | $(Fe_{0.75}B_{0.15}Si_{0.10})_{96}Ta_4$ | 0.5 | 845 | 890 | 45 | 0.59 | 100 | 1.46 | 3.0 |
| Inventive Example 13 | $(Fe_{0.75}B_{0.15}Si_{0.10})_{94}Ta_6$ | 1.0 | 830 | 880 | 50 | 0.60 | 100 | 1.45 | 2.7 |
| Inventive Example 14 | $(Fe_{0.74}Ga_{0.33}B_{0.14}Si_{0.09})_{98}Nb_2$ | 0.5 | 780 | 820 | 40 | 0.59 | 100 | 1.48 | 3.0 |
| Comparative Example 1 | $Fe_{75}B_{15}Si_{10}$ | 0.5 | | | | crystalline | | | |
| Comparative Example 2 | $(Fe_{0.75}B_{0.15}Si_{0.10})_{99.5}Nb_{0.5}$ | 0.5 | | | | crystalline | | | |
| Comparative Example 3 | $(Fe_{0.775}B_{0.125}Si_{0.10})_{99.5}Nb_{0.5}$ | 0.5 | | | | crystalline | | | |
| Comparative Example 4 | $(Co_{0.705}Fe_{0.045}B_{0.15}Si_{0.10})_{99.5}Nb_{0.5}$ | 0.5 | | | | crystalline | | | |
| Comparative Example 5 | $(Fe_{0.75}B_{0.15}Si_{0.10})_{89}Nb_{11}$ | 0.5 | | | | crystalline | | | |
| Comparative Example 6 | $(Fe_{0.8}B_{0.2})_{96}Nb_4$ | 0.5 | | | | crystalline | | | |
| Comparative Example 7 | $(Fe_{0.8}Si_{0.2})_{96}Nb_4$ | 0.5 | | | | crystalline | | | |

Further, the vitrification in each of the cast bars of Inventive Examples 1 to 14 and Comparative Examples 1 to 7 was checked through X-ray diffraction analysis, and the sample sections were observed by an optical microscope.

In Inventive Examples 1 to 14, the supercooled-liquid temperature interval ($\Delta T_\chi$) expressed by the following formula: $\Delta T_\chi = T_\chi - T_g$ (wherein $T_\chi$ is a crystallization temperature, and $T_g$ is a glass transition temperature) was 40 K or more, and the volume fraction ($V_{f\text{-amo.}}$) of a glass phase was 100% in the form of a cast bar with a diameter of 0.5 to 2.0 mm.

In contrast, Comparative Examples 1 which contains the element M in an amount of 1 atomic % or less or contains no element M were crystalline in the form of a cast bar with a diameter of 0.5 mm. While Comparative Example contains Nb as the element M, the content of Nb is 11 atomic % which is outside the alloy composition range of the present invention. As a result, it was crystalline in the form of a cast bar with a diameter of 0.5 mm. Comparative Examples 6 and 7 containing 4 atomic % of the element M but no Si or B were crystalline in the form of a cast bar with a diameter of 0.5 mm.

Figure 1:
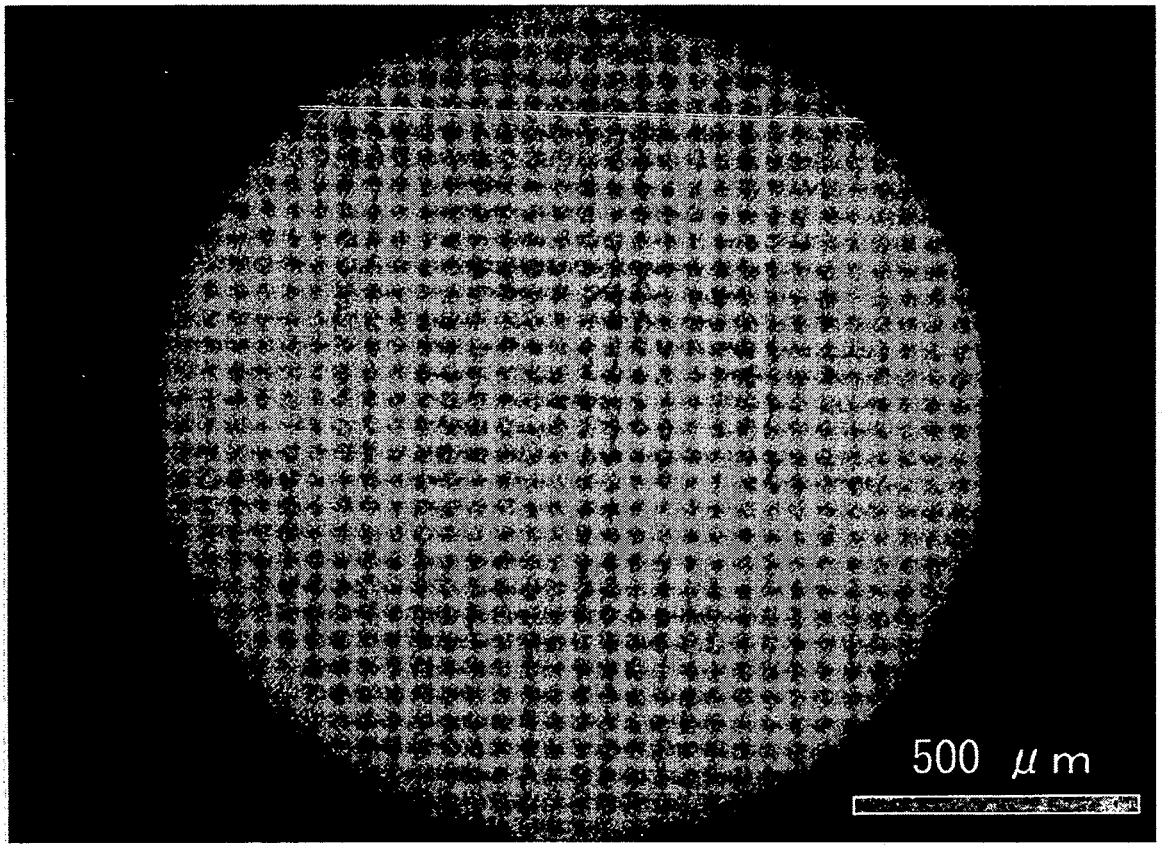
FIG. 1 is an optical micrograph showing the sectional structure of a cast bar in one Inventive Example.

FIG. 1 is an optical micrograph showing the sectional structure of the obtained cast bar with a diameter of 1.5 mm. In the optical micrograph of FIG. 1, no contrast of crystal particles is observed. This clearly proves the formation of metallic glass.

All of Inventive Examples has a high saturation magnetization of 1.4T or more. In particular, Inventive Examples 1 to 3 and 6 to 8 have a high saturation magnetization of 1.5T despite of high glass forming ability.

INVENTIVE EXAMPLE 15

Figure 2:
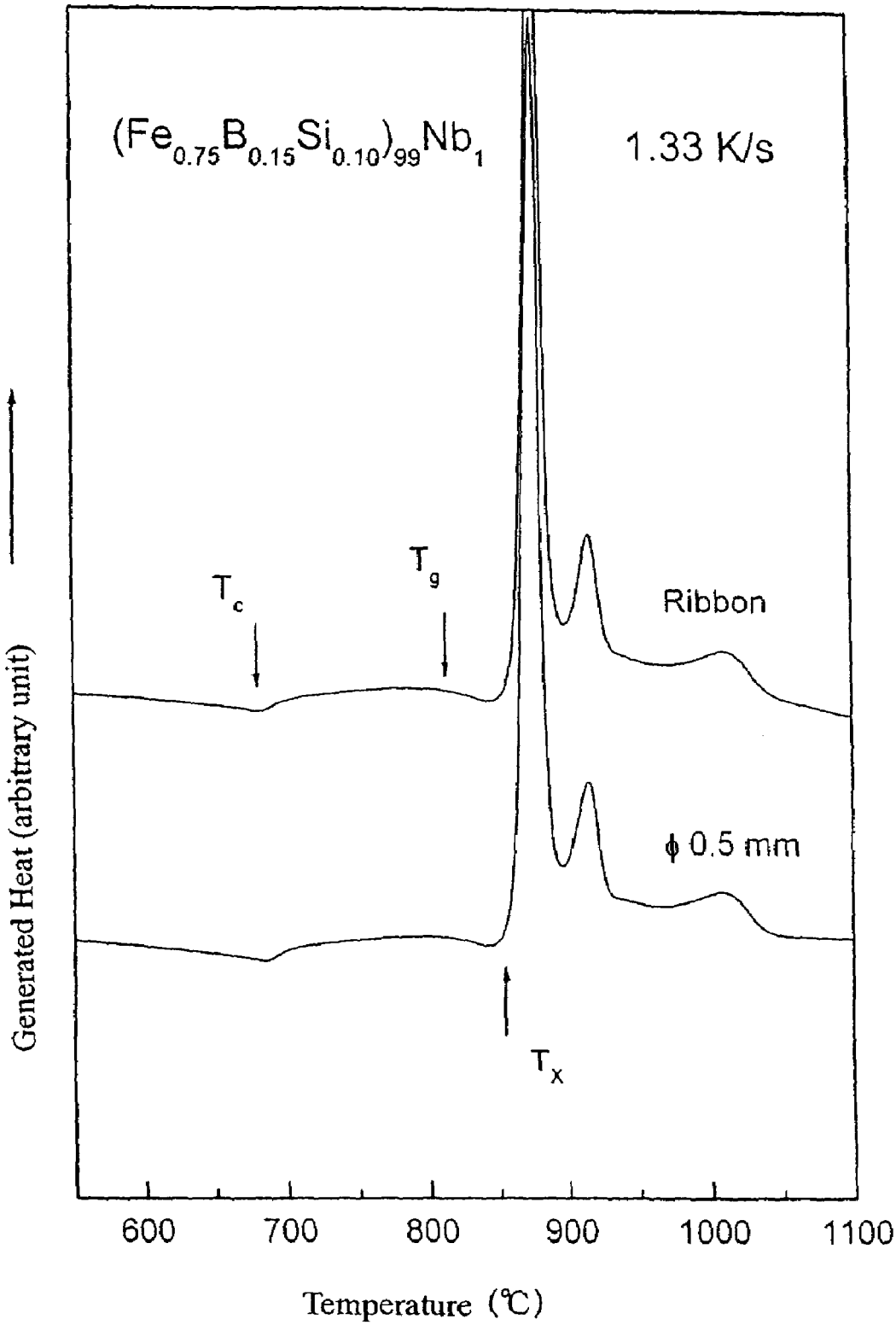
FIG. 2 is a graph showing thermal analysis curves of a cast bar obtained in Inventive Example 1 and a ribbon obtained in Inventive Example 15.

A molten alloy with the same composition as that of Inventive Example 1 was rapidly solidified through a conventional melt-spinning process to prepare a ribbon material having a thickness of 0.025 mm and a width of 2 mm. FIG. 2 shows thermal analysis curves of the cast bar obtained in Inventive Example 1 and the ribbon material obtained in Inventive Example 15. As seen in FIG. 2, there is not any difference between the ribbon material and the bulk material.

INVENTIVE EXAMPLE 16

Figure 3:
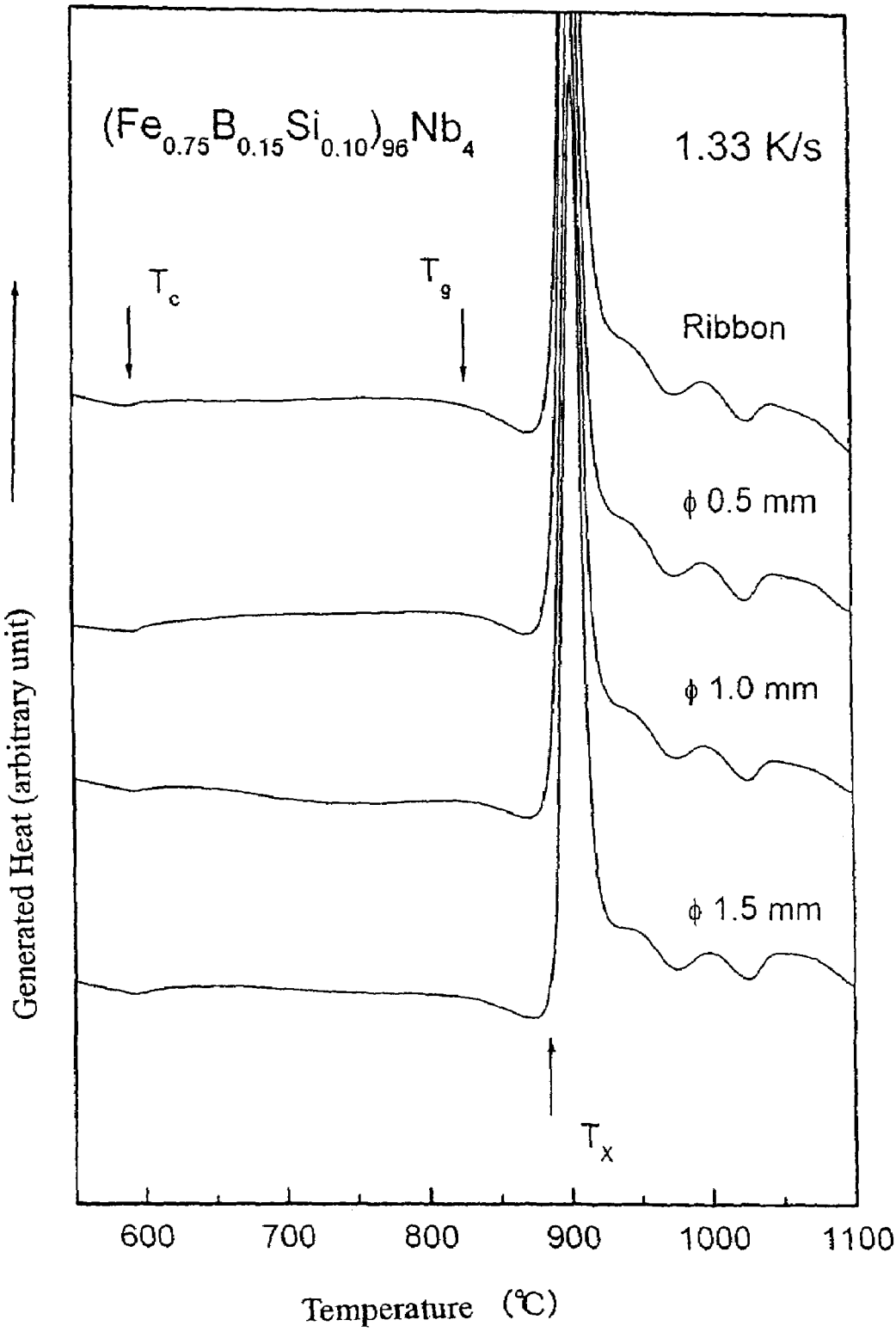
FIG. 3 is a graph showing thermal analysis curves of a cast bar obtained in Inventive Example 3 and a ribbon obtained in Inventive Example 16.

A molten alloy with the same composition as that of Inventive Example 3 was rapidly solidified through a conventional melt-spinning process to prepare a ribbon material having a thickness of 0.025 mm and a width of 2 mm. FIG. 3 shows thermal analysis curves of the cast bar obtained in Inventive Example 3 and the ribbon material obtained in Inventive Example 16. As with the above case, no difference is observed between the ribbon material and the bulk material in FIG. 3.

Figure 4:
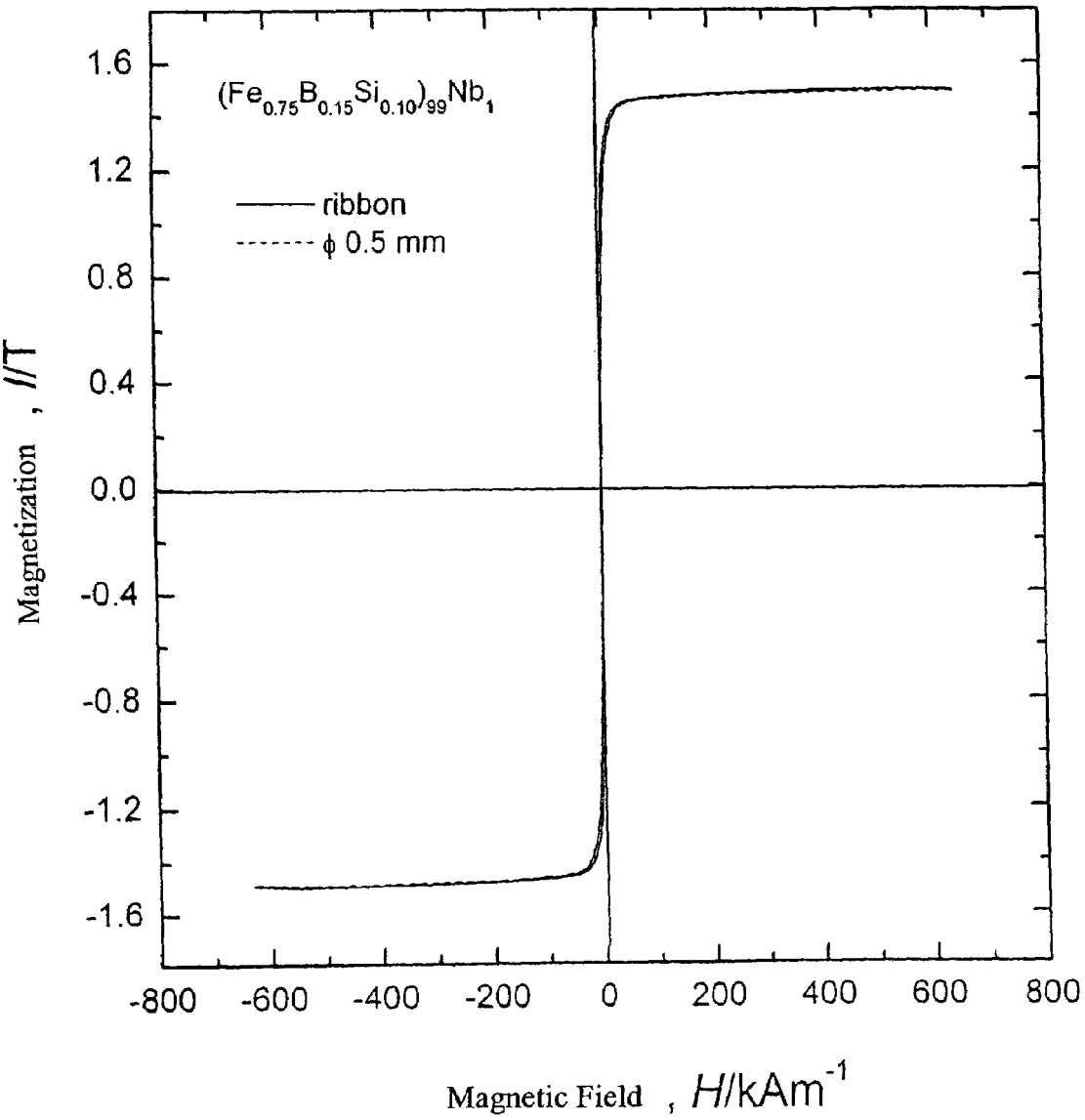
FIG. 4 is a graph showing I-H hysteresis curves of the cast bar obtained in Inventive Example 1 and the ribbon obtained in Inventive Example 15, based on the measurement of their magnetic characteristics using a vibrating-sample magnetometer.

FIG. 4 shows I—H hysteresis curves of the cast bar obtained in Inventive Example 1 and the ribbon obtained in Inventive Example 15, based on the measurement of their magnetic characteristics using a vibrating-sample magnetometer. These curves show that both the Inventive Example 1 and 15 exhibit excellent soft magnetic characteristics.

Figure 5:
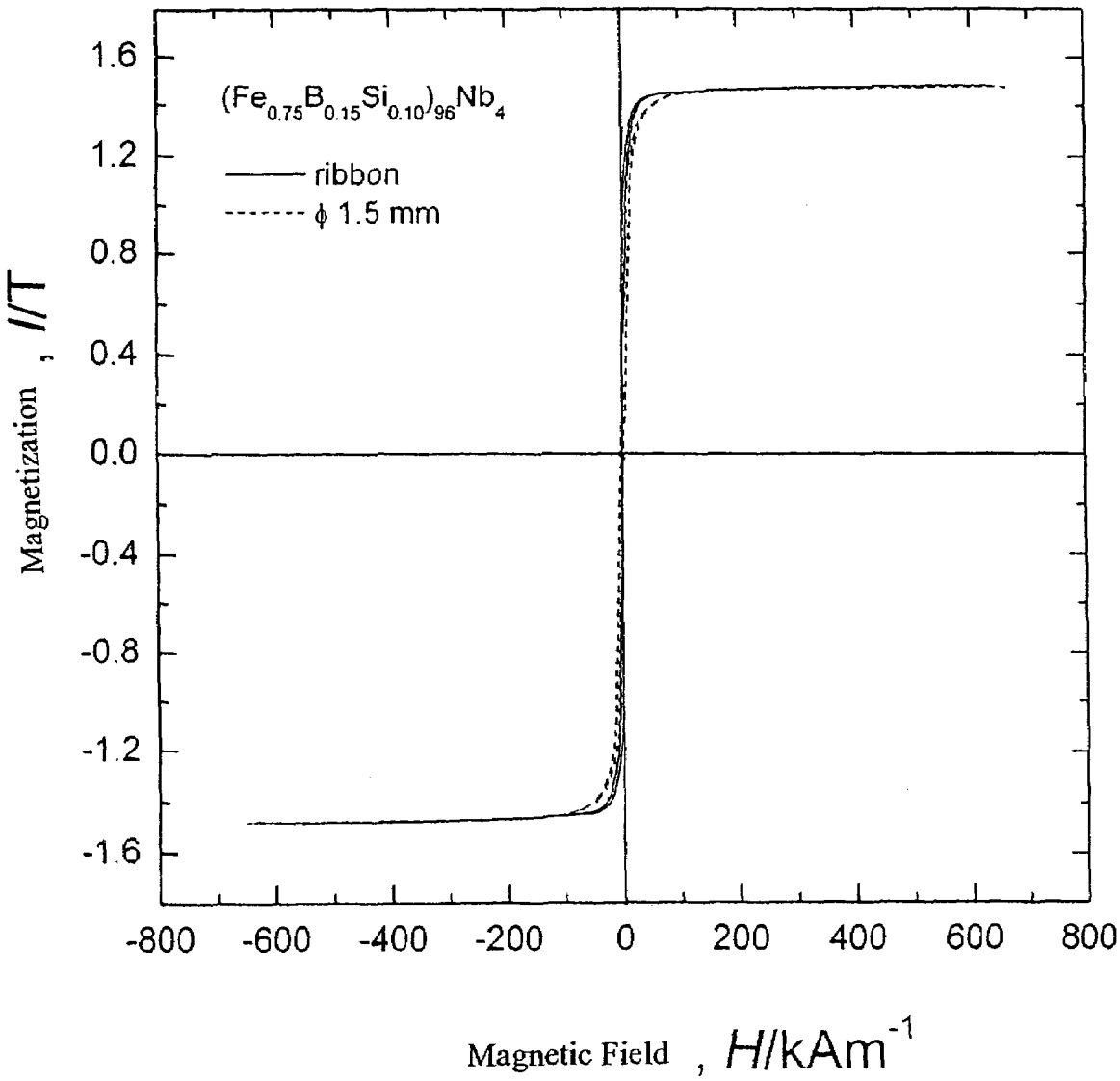
FIG. 5 is a graph showing I-H hysteresis curves of the cast bar obtained in Inventive Example 3 and the ribbon obtained in Inventive Example 16, based on the measurement of their magnetic characteristics using a vibrating-sample magnetometer.

FIG. 5 shows I—H hysteresis curves of the cast bar obtained in Inventive Example 3 and the ribbon obtained in Inventive Example 16, based on the measurement of their magnetic characteristics using a vibrating-sample magnetometer. These curves show that both the Inventive Example 3 and 16 exhibit excellent soft magnetic characteristics.

INDUSTRIAL APPLICABILITY

As mentioned above, the Fe—B—Si-base metallic glass alloy of the present invention has excellent glass forming ability which achieves a critical thickness or diameter of 1.5 mm or more and allows metallic glass to be obtained through a copper-mold casting process. Thus, the present invention can practically provide a large metallic glass product having high saturation magnetization.

What is claimed is:

1. A soft magnetic Fe—B—Si-based metallic glass alloy product comprising metallic glass alloy being represented by the following composition formula:

$$(Fe_{1-a-b}B_aSi_b)_{100-\chi}M_\chi,$$

wherein a and b represent an atomic ratio, and satisfy the following relations: $0.125 \leqq a \leqq 0.17$, $0.10 \leqq b \leqq 0.15$ and $0.225 \leqq a+b \leqq 0.3$ M is one or more elements selected from the group consisting of Zr, Nb, Ta, Hf, Mo, Ti, V, Cr. Pd and W, and $\chi$ satisfies the following relation: 1 atomic $\% \leqq \chi \leqq 10$ atomic %.

wherein said metallic glass alloy has a supercooled-liquid temperature interval ($\Delta T_\chi$) of 40 K or more, a reduced glass-transition temperature ($T_g/T_m$) of 0.56 or more, said glass alloy product as cast has minimum thickness or diameter of 0.5 mm or more, and a volume fraction (Vf-amo) of a glass phase is 100%, and a saturation magnetization of more than 1.4 T and coercive force of 3.7A/m or less.

2. The soft magnetic Fe—B—Si-based metallic glass alloy as defined in claim 1, which contains 3 atomic % or less of one or more elements selected from the group consisting of P, C, Ga and Ge.

* * * * *